United States Patent [19]

Lanz et al.

[11] 4,238,896

[45] Dec. 16, 1980

[54] CUTTING EDGE ASSEMBLY FOR A LOADER BUCKET

[75] Inventors: William E. Lanz, Joliet; Visvaldis A. Stepe, Willow Springs, both of Ill.

[73] Assignee: Caterpillar Tractor Co., Peoria, Ill.

[21] Appl. No.: 69,426

[22] Filed: Aug. 24, 1979

Related U.S. Application Data

[63] Continuation of Ser. No. 846,004, Oct. 27, 1977, abandoned.

[51] Int. Cl.[3] ..... E02F 9/28

[52] U.S. Cl. ..... 37/141 R

[58] Field of Search ..... 37/141 R, 141 T, 142 R, 37/142 A, 118 R, 118 A

[56] References Cited

U.S. PATENT DOCUMENTS

| | | | |
|---|---|---|---|
| 1,843,205 | 2/1932 | Clark | 37/141 T |
| 2,164,988 | 7/1939 | De Biasi | 37/141 T |
| 3,426,459 | 2/1969 | Petersen | 37/142 R |
| 3,497,973 | 3/1970 | Campbell | 37/141 R |
| 3,520,076 | 7/1970 | Nichols | 37/141 R |
| 3,621,594 | 11/1971 | Hahn et al. | 37/141 T |
| 3,653,133 | 4/1972 | Black et al. | 37/142 R |
| 3,685,177 | 8/1972 | Hahn et al. | 37/141 R |
| 3,762,079 | 10/1973 | Lukavich et al. | 37/141 R |
| 3,851,413 | 12/1974 | Lukavich | 37/141 T |
| 3,984,929 | 10/1976 | Meyer et al. | 37/141 R |
| 3,997,988 | 12/1976 | Klett | 37/141 R |

FOREIGN PATENT DOCUMENTS

| | | | |
|---|---|---|---|
| 1146308 | 3/1969 | United Kingdom | 37/118 A |
| 168195 | 3/1965 | U.S.S.R. | 37/141 R |

OTHER PUBLICATIONS

*Dixie Contractor*, "Bocyrus Blades" (advertisement), p. 48, 9/1975.

*Primary Examiner*—Clifford D. Crowder
*Attorney, Agent, or Firm*—Phillips, Moore, Weissenberger, Lempio & Majestic

[57] ABSTRACT

A loader bucket for an earthmoving machine including a bucket base having a forward end, a plurality of tooth adapters connected to and spaced along the forward end and each supporting a tooth, and a plurality of cutting edges, each extending forwardly of the front end between two adjacent adapters for cutting into the earth. The cutting edges are fastened to the lower surface of the base with bolt assemblies so as to be reversible end-to-end.

5 Claims, 5 Drawing Figures

Fig-3-
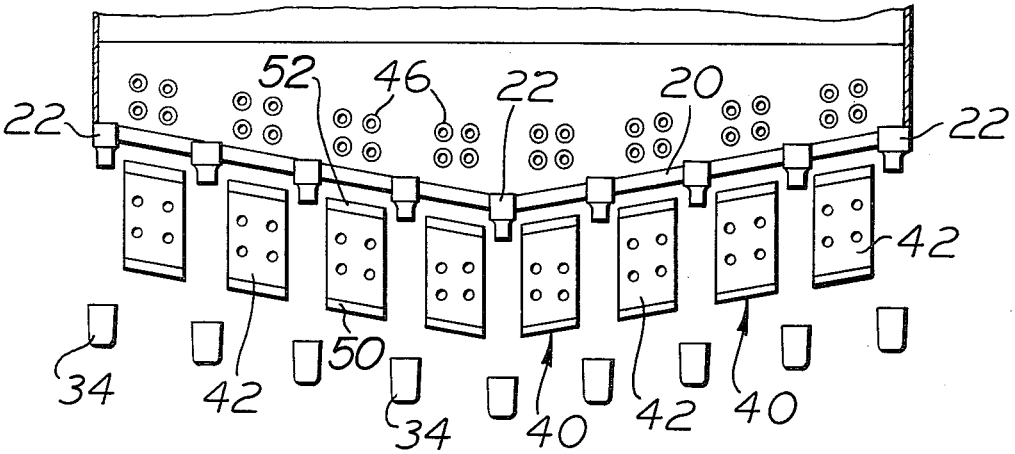
Fig-5-
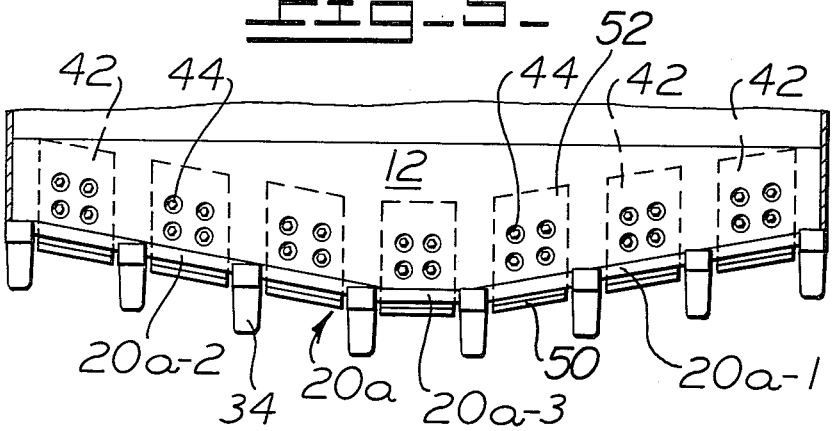
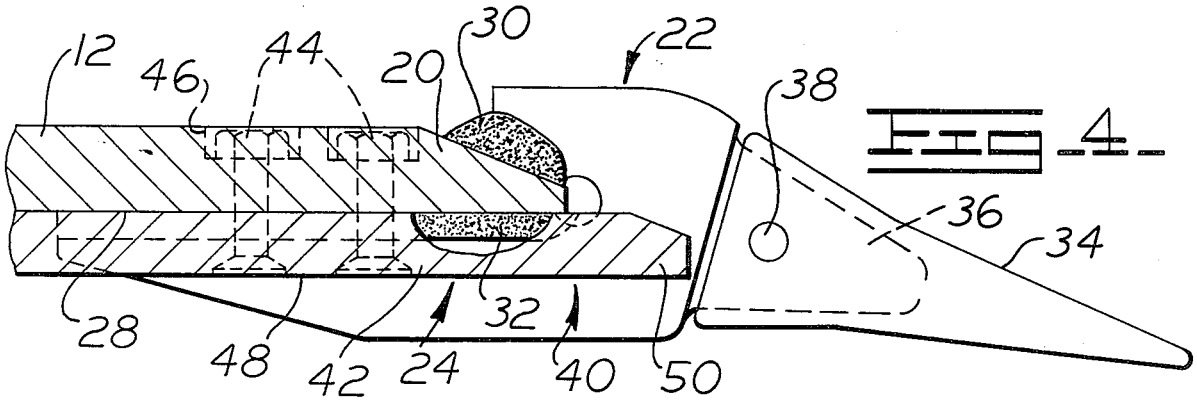
Fig-4-

CUTTING EDGE ASSEMBLY FOR A LOADER BUCKET

This is a continuation, of Ser. No. 846,004, filed Oct. 27, 1977 now abandoned.

BACKGROUND OF THE INVENTION

This invention relates to an earthworking implement, such as a bucket loader and, more particularly, to an assembly attached to the implement for cutting into the earth.

Loader buckets presently in commercial use include a variety of assemblies which penetrate into the earth to cut the same so that it can be loaded into the bucket. Typically, these assemblies include a cutting edge connected to the forward end of the base of the bucket for cutting the earth. It is, of course, well known that the cutting edge becomes worn after a period of use. Consequently, teeth forwardly extending of the cutting edge are also coupled to the bucket base by adapters to reduce the wear and improve the penetration of the cutting edge. The problems resulting from wear are also reduced through the use of cutting edges which are removably secured to the bucket base so that when an edge is sufficiently worn, it can be either totally replaced or reversed, end to end, on the base to provide a new cutting edge.

Despite these solutions to the wear problem, the prior art does not provide simple, inexpensive, and easily replacable or reversible cutting edges. For example, while only a small area of the cutting edge may be worn, the entire edge is replaced by, for example, reversing the edge. Replacement of the worn edge can also be complicated by the fact that in some assemblies, the tooth adapters must also be removed to provide a new cutting edge. Furthermore, the prior cutting edges have not been mounted to the bucket base in a way that secures them to the bucket for use in hard-working environments, such as rock crushing, while still enabling them to be easily removed from the bucket for repair or replacement.

SUMMARY OF THE INVENTION

The present invention is directed to overcoming one or more of the problems as set forth above.

According to the present invention, a cutting edge assembly for an earthmoving machine has a base with a forward end, a plurality of tooth adapters connected to and spaced along the forward end, and a plurality of cutting edge means, each extending forwardly of the forward end between two adjacent adapters, for cutting into the earth, the cutting edge means being removably fastened to the lower surface of the base.

BRIEF DESCRIPTION OF THE DRAWINGS

FIG. 3 is an exploded top view of the arrangement shown in FIG. 2.

FIG. 4 is a view taken along lines 4—4 of FIG. 2.

FIG. 5 is a top view of another embodiment of a cutting edge and tooth-adapter assembly of this invention.

DETAILED DESCRIPTION OF THE DRAWINGS

Figure 1:
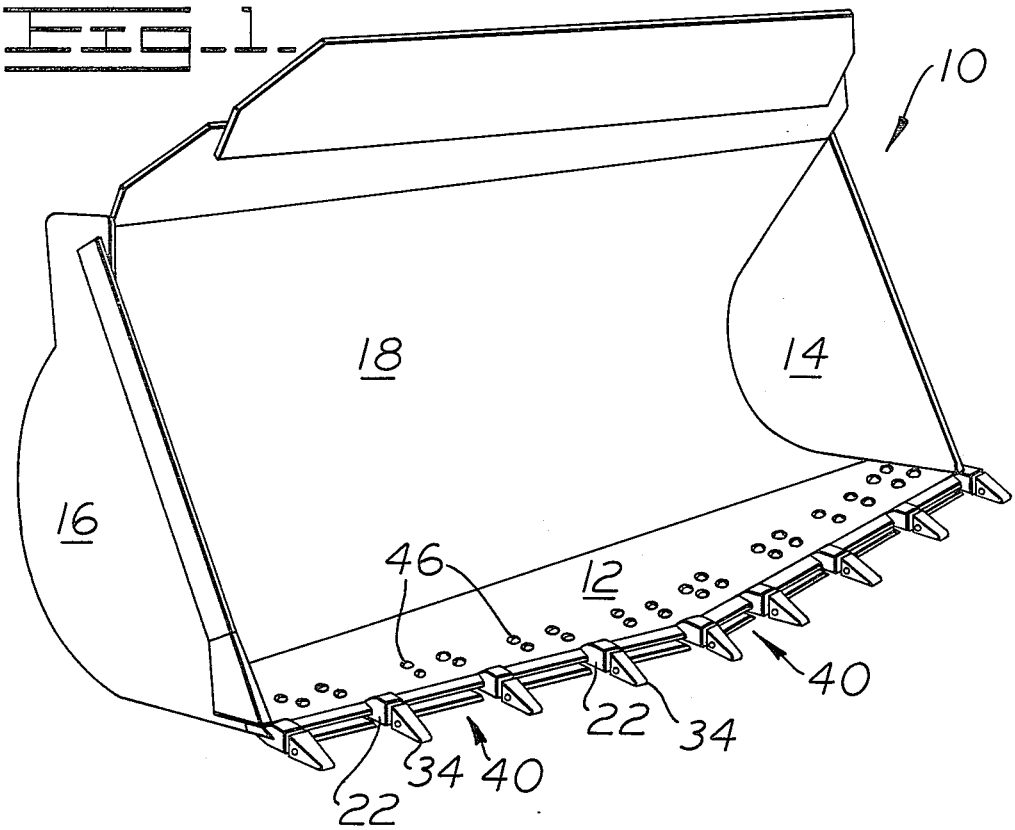
FIG. 1 is a front isometric view of a loader bucket employing the detachable cutting edge and tooth adapter arrangement of this invention.

FIG. 1 illustrates a loader bucket 10 having an elongated and flat base 12 extending between two side walls 14 and 16 and connected to the lower end of a rear wall 18. The base 12 has a single piece forward end 20 which may be shaped to form a cutting edge, as shown more clearly in FIG. 4, though this edge 20 is not the primary cutting edge of the bucket 10.

Figure 2:
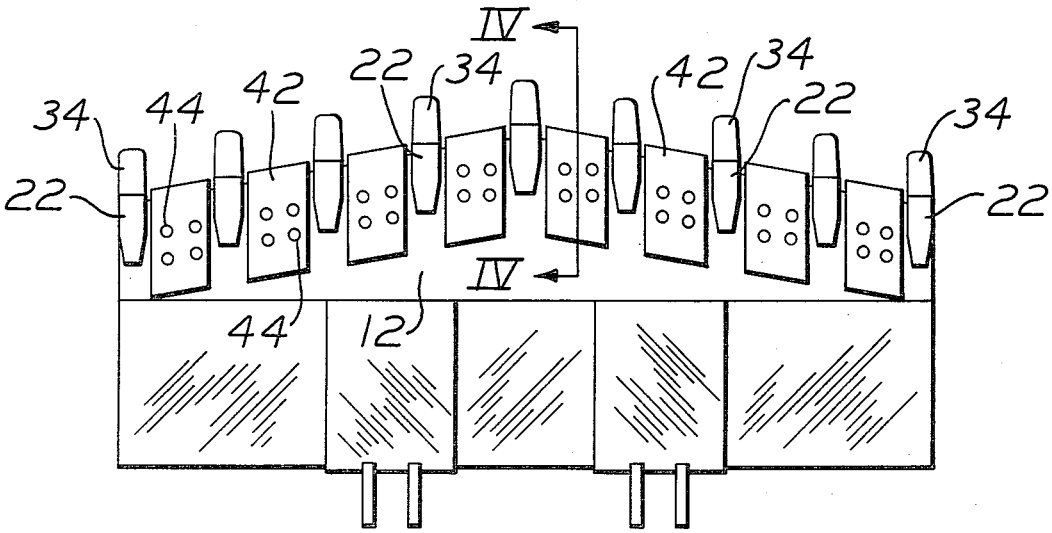
FIG. 2 is a plan view of one embodiment of the cutting edge and tooth adapter arrangement, viewed from the underside of the bucket.

As illustrated more clearly in FIGS. 2–4, a plurality of adapters 22 are spaced along the forward end 20 of bucket base 12. Each adapter 22 has a bifurcated rear end 24 which straddles the upper surface 26 and lower surface 28 of the base 12 and is welded to the surfaces 26 and 28 by a pair of welds 30 and 32, respectively. Each adapter 22 has a tooth 34 coupled to its forward end 36 by a pin assembly 38 to hold the tooth in a conventional manner.

The primary cutting edge of the bucket 10 is shown at 40 and comprises a plurality of separate sections or edges 42. As shown in FIG. 4, each section 42 of the cutting edge 40 is removably secured to the base 12 by a plurality of bolt assemblies 44. The top ends or nuts 45 of bolt assemblies 44 are housed within recesses 46 of the bucket base 12, while the lower ends of the bolt assemblies 44 are countersunk into the bottom surface 48 of the sections 42. As can be seen, the bolt assemblies 44 do not protrude from either top surface 26 of base 12 nor the bottom surface 48 of section 42, so that they won't be sheared by, for example, rocks which are scooped into the bucket 10, thereby reducing the likelihood that the sections 42 will fail or snap off the base 12.

Each section 42 has a cutting end 50 extending forwardly from the edge 20 and another cutting end 52 beneath the surface 28 of the base 12. In the embodiment of FIGS. 2–4, each section 42 is in the shape of a parallelogram and individually bolted to the base 12 between two adjacent adapters 22. As shown in FIG. 3, the secondary cutting edge or forward end 20 has the shape of a V-shaped spade with an adapter 22 at the apex of the spade.

The other embodiment of FIG. 5 is identical to the embodiment of FIGS. 2–4, except for the modified structure to be described. Like numerals are used to depict structure which is the same in both embodiments. In this FIG. 5 embodiment, the sections 42 are also shaped in the form of a parallelogram. The bucket base 12 has a single piece forward end **20*a* in the shape of a V-shaped spade which, unlike edge 20, has two angled segments 20*a*-1 and 20*a*-2 joined by a straight segment 20*a*-3, with adapters 22 connected on either side of this segment 20*a*-3**.

As already noted, FIGS. 1–5 illustrate a bucket base 12 having the shape of a V-shaped spade. However, the cutting edge or forward ends 20 and **20*a* also could be straight, rather than V-shaped. With such straight edge, all the sections 42** then could be in the form of rectangles.

While teeth 34 function to improve the penetration and reduce the wear of the primary cutting end 50 of each segment 42, after a period of use one or more of these sections will have sufficiently worn so as to require a new cutting end. With this invention, when such wear has occurred, a new cutting end 52 can be used simply by removing the bolts 44 and reversing the section 42 end to end so that end 52 now becomes the cutting end. After this reversal, the section 42 again is bolted to the base 12 with bolts 44. These relatively small segments 42, which fit between adjacent adapters 22, make it easy to replace only those small areas of the entire cutting edge 40 which may have worn. Furthermore, the adapters 22 need not be removed from the bucket base 12 when reversing a section 42, as evidenced by the fact that they may be welded to the base 12.

While the invention has been particularly shown and described with reference to a preferred embodiment thereof, it will be understood by those skilled in the art that the foregoing and other changes in form and details may be made therein without departing from the spirit and scope of the invention.

The embodiments of the invention in which an exclusive privilege or property is claimed are defined as follows:

1. A cutting edge assembly for an earthmoving machine, comprising:

(a) a base;

(b) a plurality of separate tooth adapters being spaced apart along said base;

(c) first means for fastening each of said adapters to said base;

(d) a plurality of separate cutting edges, each of said cutting edges being in position between two adjacent said adapters and being laterally spaced from said two adjacent adapters; and (e) second means for removably fastening each of said cutting edges to said base and being adapted for coupling only through said base and said cutting edges.

2. A cutting edge assembly according to claim 1 wherein said second means for removably fastening includes a plurality of bolt assemblies.

3. A cutting edge assembly according to claim 2 wherein said first means for fastening includes welds.

4. A cutting edge assembly for an earthmoving machine, comprising:

(a) a base having a forward end, an upper surface and a lower surface;

(b) a plurality of separate tooth adapters being spaced apart along said forward end, each of said adapters having a bifurcated rear end straddling said upper surface and said lower surface;

(c) means for fixedly fastening each of said adapters to said forward end;

(d) a plurality of separate, parallelogram-shaped cutting edges having a flat top surface in contact with said lower surface and a flat bottom surface, each of said cutting edges being in position between two adjacent said adapters and being laterally spaced from said two adjacent adapters; and (e) a plurality of bolt assemblies extending only through said base and said cutting edge.

5. A cutting edge assembly according to claim 4 wherein said upper surface of said base and said flat bottom surface of said cutting edges have recesses, and wherein said bolt assemblies have one end in said recesses of said upper surface so as not to protrude therefrom and another end in said recesses of said bottom surface so as not to protrude therefrom.

* * * * *

Disclaimer 4,238,896.—*William E. Lanz,* Joliet and *Visvaldis A. Stepe,* Willow Springs, Ill. CUTTING EDGE ASSEMBLY FOR A LOADER BUCKET. Patent dated Dec. 16, 1980. Disclaimer filed Feb. 22, 1983, by the assignee, *Caterpillar Tractor Co.*

Hereby enters this disclaimer to all claims of said patent.

[*Official Gazette April 19, 1983.*]